US005283011A

United States Patent [19]

McClintic et al.

[11] Patent Number: 5,283,011

[45] Date of Patent: Feb. 1, 1994

[54] CARBURETOR WITH DOUBLED FLOAT VALVE FUEL FLOW

[75] Inventors: John W. McClintic; Jeff J. McClintic, both of Albuquerque, N. Mex.

[73] Assignee: McClintic RDM, Inc., Albuquerque, N. Mex.

[21] Appl. No.: 5,100

[22] Filed: Jan. 15, 1993

[51] Int. Cl.[5] ..... F02M 5/02

[52] U.S. Cl. ..... 261/23.2; 261/34.1; 261/72.1; 261/DIG. 50

[58] Field of Search ..... 261/23.2, DIG. 50, 72.1, 261/34.1

[56] References Cited

U.S. PATENT DOCUMENTS

| | | | |
|---|---|---|---|
| 2,882,029 | 4/1959 | Henning | 261/72 |
| 2,973,947 | 3/1961 | Sterner | 261/34.1 |
| 3,232,587 | 2/1966 | Nastas et al. | 261/DIG. 50 |
| 3,372,912 | 3/1968 | Benmore | 261/36 |
| 3,719,352 | 3/1973 | Harrison et al. | 261/23 |
| 4,100,663 | 7/1978 | Crum | 261/23.2 |
| 4,168,289 | 9/1979 | Saunion | 261/DIG. 50 |
| 4,289,714 | 9/1981 | Duncan et al. | 261/34 |
| 4,331,617 | 5/1982 | Tamaki et al. | 261/72.1 |
| 4,430,275 | 2/1984 | Horton | 261/18 |
| 4,556,032 | 12/1985 | Miller | 261/34.1 |
| 4,576,761 | 3/1986 | Gruenwald | 261/DIG. 50 |
| 4,776,988 | 10/1988 | Neal | 261/34.1 |
| 5,049,318 | 9/1991 | Guntly et al. | 261/34.1 |
| 5,057,249 | 10/1991 | Baltz et al. | 261/72.1 |

*Primary Examiner*—Tim Miles

*Attorney, Agent, or Firm*—Jacobson, Price, Holman & Stern

[57] ABSTRACT

A carburetor of the "HOLLEY" 4150 or 4500 series is modified to double the fuel intake capacity thereof, to limit fuel sloshing in the float bowls thereof, to provide an upper fuel transfer passage between a pair of fuel inlet passages for each float bowl, to enable ready removable and replacement of the main jets independent of removable of the float bowls and to provide alternate main jet fuel pickup zones in different plan areas of the bottom of the float bowls.

14 Claims, 3 Drawing Sheets

CARBURETOR WITH DOUBLED FLOAT VALVE FUEL FLOW

BACKGROUND OF THE INVENTION

Field of the Invention

This invention relates to a carburetor and more specifically to a carburetor such as the "HOLLEY", 4150 or 4500 series carburetor utilized for racing purposes. The carburetor has been modified to the extent that each primary fuel bowl is equipped with a pair of float controlled fuel inlet needle and seat assemblies to thereby enable fuel flow to the main jets approximately 2.3 times maximum fuel flow rate of an unmodified carburetor to which fuel is supplied at 8 psi. In addition, the carburetor is equipped with remote float bowl fuel pickup devices to ensure continuous maximum fuel pickup during periods of straight line and lateral acceleration. It further includes a fuel inlet transfer passage, float bowl baffle structure and readily changeable main jets.

DESCRIPTION OF RELATED ART

Various different forms of carburetors including some features which are similar to those incorporated in the instant invention are disclosed in U.S. Pat. Nos. 2,882,029, 3,372,912, 3,719,352, 4,289,714 and 4,430,275. However, these previously known forms of carburetors do not include the improved fuel inlet capacity, the remote fuel pickup structures, the fuel inlet transfer passage, the float bowl baffle structure or the readily changeable main jets of the instant invention.

SUMMARY OF THE INSTANT INVENTION

The carburetor of the instant invention includes dual float chambers or bowls which each are provided with dual floats, needles, seats and fuel inlets. This provides a multiple of four of each of these items per carburetor and enhances the fuel receiving capacity of the fuel chambers of the carburetor by at least 200%.

A conventional of "HOLLEY" carburetor bowl has two main jets for discharging fuel therefrom into the carburetor body and only one float valve needle and seat assembly. To overcome this deficiency (an approximately 60% inlet versus outlet or jet area) most users are employing very high pressure fuel systems in the range of 10 to 30 psi on the inlet line. At wide open throttle this works fairly well, but at idle or low speed there is a great problem with the float overcoming this high pressure Further, such high pressure fuel systems are very expensive and represent a safety hazard.

With the instant invention, the capacity of fuel inlet to the bowl has been doubled without sacrificing low speed drivability and without an overly high pressure inlet system. Thus, not only is the low speed drivability retained but the need for a high pressure fuel system and the attendant reduction in safety is eliminated.

In automobile racing high lateral G forces may cause even a carburetor modified to include opposite side floats in each float bowl to experience reduced fuel inlet rate due to the fact that the fuel in the float bowl will move by centrifugal force to one side thereof to close one of the float valves. Accordingly, the carburetor of the instant invention equips each float bowl with a high level transfer port through which fuel may be transferred from either fuel inlet to the opposite float valve. This assures ample fuel being supplied to both float valves during high lateral G forces. In addition, the high level transfer port also serves the same purpose during straight line acceleration when the carburetor is mounted on an engine in a 90° rotated position with the float bowls disposed to opposite sides of the engine.

The carburetor of the instant invention further includes remote fuel pickups by which the fuel supplied to the associated main jets may be picked up from remote positions within the bottom of the associated float bowls.

The main object of this invention is to provide a carburetor capable of inflowing fuel into the float bowls thereof downstream from the associated float controlled inlet valves at a rate in excess of the rate of fuel which may pass through the main metering jets of the carburetor during full throttle operation and without resorting to increased fuel inlet pressure.

Another object of this invention is to provide a carburetor including dual fuel inlets and float controlled inlet valves for each float bowl of the carburetor and wherein the dual inlets for each float bowl are disposed at opposite sides of the carburetor and the carburetor is equipped with a fuel bypass passage communicating the fuel inlets upstream from the associated float controlled fuel inlet valves.

Another very important object of this invention is to provide a carburetor in accordance with the preceding objects and wherein the interior of the float bowl is baffled between the areas occupied by the dual floats of each float bowl.

Yet another object of this invention is to provide a carburetor equipped with remote fuel pickups for the main jets of the carburetor whereby fuel pickup for the associated stationaryily mounted main fuel jets may be varied over the area of the bottom of the associated float bowl.

Still another object of this invention is to provide a carburetor float bowl equipped with removable access plugs enabling access to, removable of and changing of the main jets of the carburetor independent of removable of the float bowls.

A final object of this invention to be specifically enumerated herein is to provide a carburetor in accordance with the preceding objects and which will conform to conventional forms of manufacture and efficient in operation so as to provide a device that will be economically feasible and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
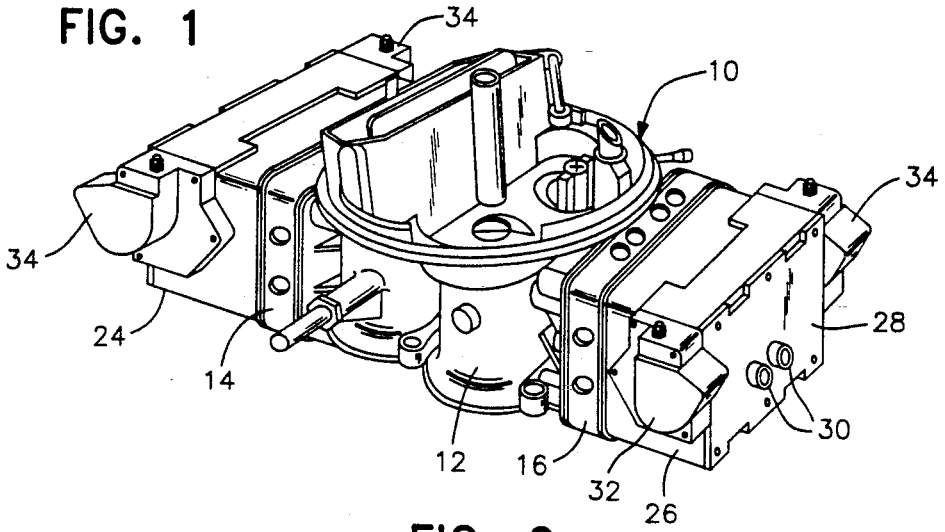
FIG. 1 is a perspective view of a Holley four venturi carburetor equipped with dual float chambers and which has been modified in accordance with the present invention.

Referring now more specifically to the drawings the numeral 10 generally designates a typical 4150 or 4500 series "HOLLEY" carburetor, with the throttle body removed, which has been modified in accordance with the present invention.

The carburetor 10 conventionally includes a main body 12 (4 venturi), secondary and primary metering blocks 14 and 16 with the metering block 16 being equipped with a power valve 18 and a pair of main jets 20 and the block 14 including a fuel enrichment valve in lieu of the power valve 18, but also including jets corresponding to the metering jets 20.

The outer sides of the blocks 14 and 16 are covered by modified open sided fuel or float bowls 24 and 26, the outer wall 28 of each fuel bowl being either permanently mounted or removable, but including a pair of removable gasketed plugs 30 for purpose to be hereinafter more fully set forth.

The ends of each fuel bowl 24 and 26 include a pair of removable fuel inlet fittings 32 and 34 and it is to be noted that the fuel bowls 24 and 26 are similarly constructed and that the removable fuel inlet fittings 32 and 34 are similarly constructed except that they are left and right handed, respectively.

Each fuel inlet fitting includes a fuel inlet passage 36 having a threaded inlet end 38 in which the discharge end of a fuel supply line (not shown) may be sealingly engaged. The discharge end of the fuel inlet passage opens into a vertical fuel passage 40 in the corresponding inlet fitting and each vertical fuel passage includes an upper end portion 42 and a lower end portion 44, the lower end portions 44 being registered with and opening into the interior of the corresponding fuel bowl and through a window 46 formed in the corresponding end wall of the associated fuel bowl. In addition, each vertical fuel passage includes an intermediate height portion 48 in which a float valve needle and seat (not shown) are disposed and each end of each float bowl includes a pivotally mounted float 50 for controlling the flow through the float valve needle and seat. Each float valve needle and seat assembly is supported by a fuel level adjusting nut 52 having a lock screw 54 operatively associated therewith and the upper portion of each fuel or float bowl includes an upper transfer passage 56 defined therethrough communicating the upper end portions 42 of the vertical fuel passages 40 upstream from the associated float valve needle and seat assembly. Thus, each fuel inlet passage 36 may provide fuel to both float valve needle and seat assemblies.

The interior of each float bowl includes a pair of foraminated vertical baffles 58 and 60 dividing the interior of each float bowl into two opposite end chamber sections and a central chamber zone as well as a foraminated horizontal baffle 62 extending between the baffles 58 and 60 about ⅓ of the distance upward from the lower ends thereof. A fibrous body 64 is tightly received between the vertical baffles 58 and 60 above the horizontal baffle 62.

Figure 7:
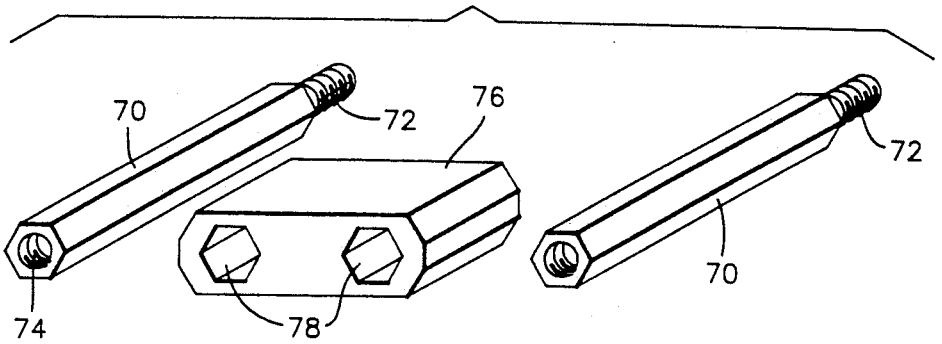
FIG. 7 is a perspective view of two of the adapters illustrated in FIG. 6 as well as an antirotation locking device for use on the adapters.
Figure 3:
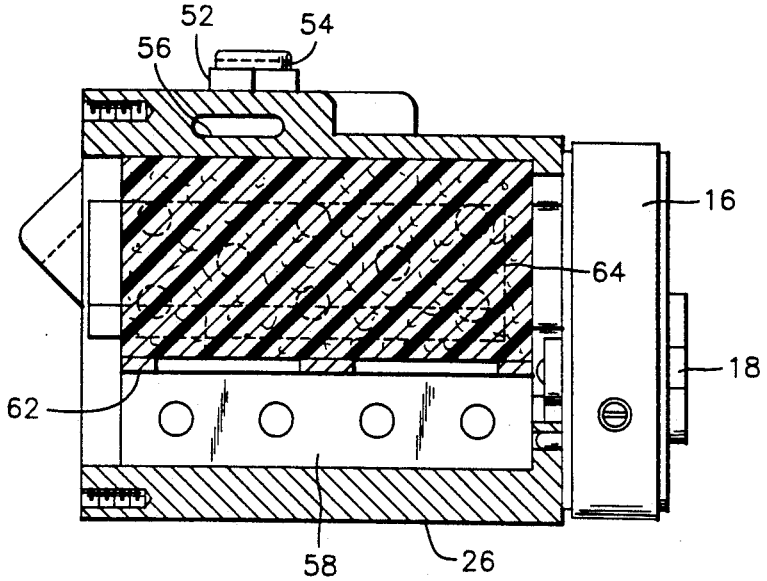
FIG. 3 is a vertical sectional view taken substantially upon the plane indicated by the section line 3—3 of FIG. 2.
Figure 5:
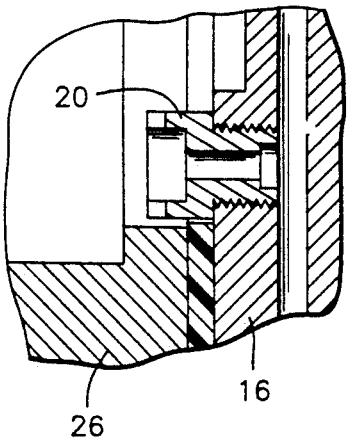
FIG. 5 is a fragmentary enlarged vertical sectional view taken substantially upon a plane passing through the center of one of the main metering jets visible in FIG. 2.
Figure 6:
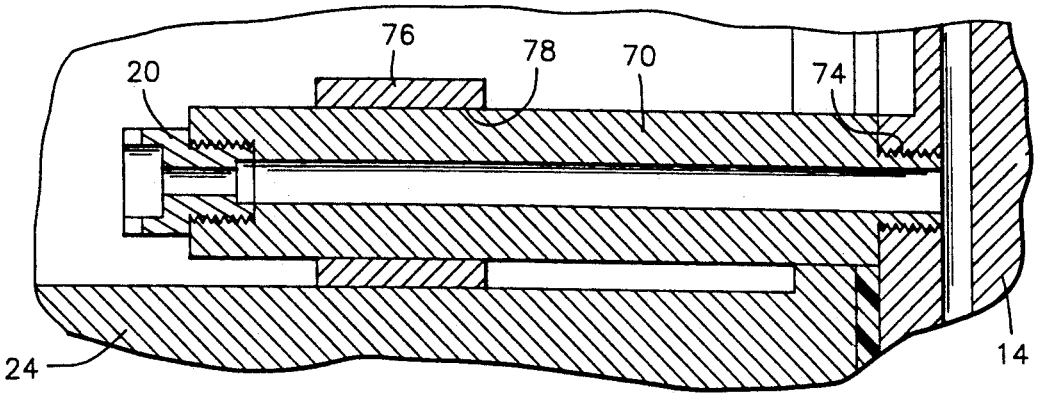
FIG. 6 is an enlarged vertical sectional view similar to FIG. 5 but illustrating a remote mounting adaptor for the metering jet for use in the rear or secondary float bowl to ensure adequate fuel pickup under heavy acceleration G forces.

Inasmuch as the main jets 20 are disposed at the open side of the fuel bowl 26 midway between the opposite outer ends of the fuel bowl, in order to ensure a proper supply of fuel to the main jets 20, the fuel level at the jets 20 must be at least appreciably above the main jets 20. However, under rapid acceleration fuel within the rear fuel bowl 24 may move away from the metering block 14 to such an extent that the corresponding main jets are exposed. In order to counteract this, a pair of tubular extensions or adapters 70, see FIGS. 6 and 7, are provided and include reduced diameter externally threaded ends 72 threadedly engageable in the bores 74 of the metering block 14 from which the jets 20 were removed and threaded counter bores on the other ends in which the jets 20 are reinstallable, the exteriors of the adapters 70 being hexagonal in cross section and there being provided a locking block 76 with hexagonal bores 78 formed therethrough. The locking block 76 may be slipped over the adapters 70 after they have been tightened in the bores 74 and before the corresponding fuel bowl is reinstalled. This rearwardly displaces the rear jets 20 such that sloshing of fuel within the rear fuel bowl 24 to the rear thereof ensures a constant fuel supply to the rearwardly displaced jets as shown in FIG. 6 as opposed to starvation of the jets 20, were they mounted in the conventional positions thereof illustrated in FIG. 5.

Figure 4:
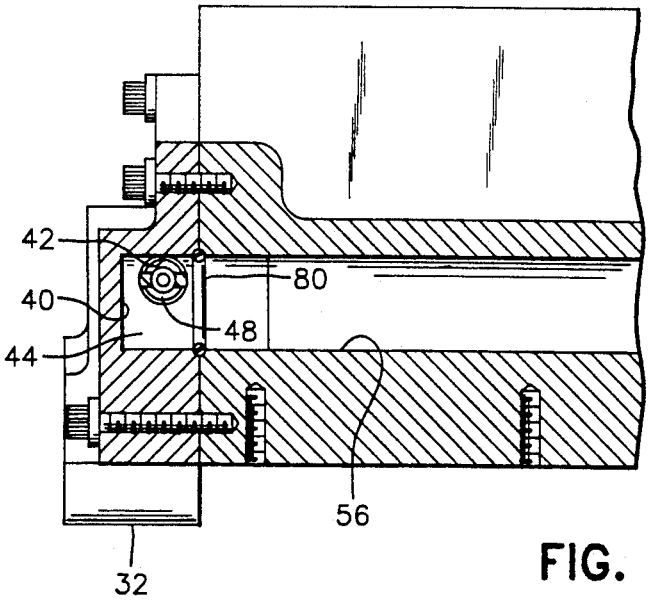
FIG. 4 is a fragmentary horizontal sectional view taken substantially upon the plane indicated by the section line 4—4 of FIG. 2.

The fuel inlets 32 and 34 each enjoy an O-ring seal 80 with the corresponding end of the transfer passage 56, see FIG. 4 and a similar O-ring seal is provided between each fuel inlet fitting 32, 34 and the associated port or window 46.

Figure 8:
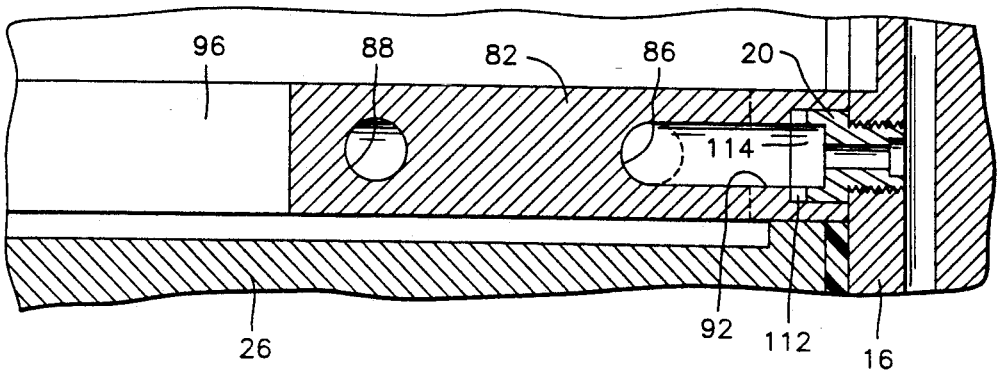
FIG. 8 is a fragmentary enlarged vertical sectional view similar to FIG. 6 but illustrating a remote fuel pickup adaptor for use in both of the float bowls in order to ensure adequate fuel pickup for the carburetor main jets during high lateral G forces.
Figure 9:
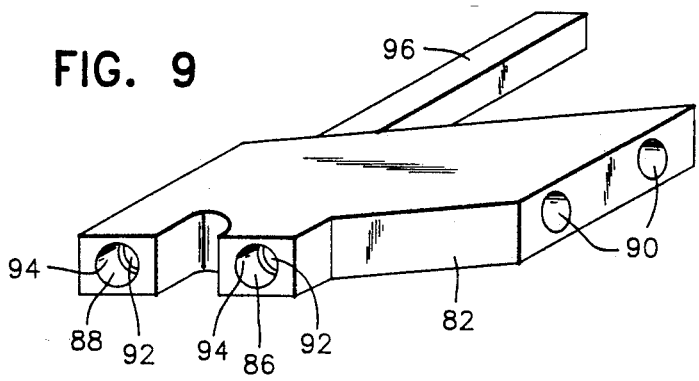
FIG. 9 is a perspective view of the adaptor illustrated in FIG. 8.

With attention now invited more specifically to FIGS. 8 and 9, there may be seen a remote fuel pickup designated by the reference numeral 82. The remote fuel pickup 82 includes a pair of angled bores 86 and 88 formed therethrough including inlet and outlet ends 90 and 92. The outlet ends 92 include counter bores 94 in which the heads of corresponding jets 20 are receivable and the inlet ends 90 are disposed toward the right ends of the fuel bowls 24 and 26 toward which the fuel within the bowls is thrown by centrifugal force during left hand turns while oval track racing. Thus, a constant supply of fuel is assured to the metering jets 20 during oval racing. In addition, each of the remote fuel pickups 82 includes an abutment leg 96 for closely abutting the inner surface of the outer wall 28 of the corresponding fuel bowl as it is secured over the associated metering block.

Figure 10:
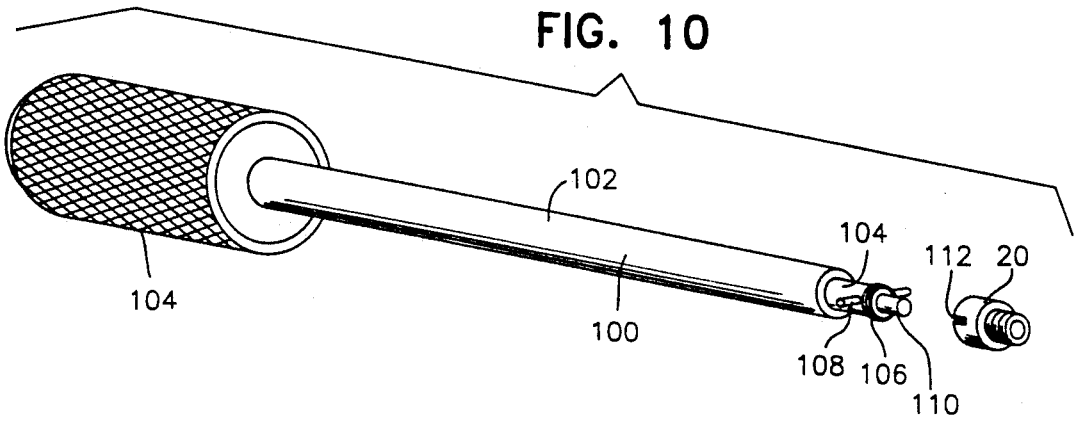
FIG. 10 is a perspective view of a main metering jet removal and changing tool for use in removable and changing of the main metering jets through the removal jet access plugs carried by the outer walls of the float bowls.

If the remote fuel pickups 82 were not utilized, either the metering jets supported from the corresponding metering bodies or the jets supported from the adapters 70 may be changed by removing the corresponding plugs 30 and utilizing the tool 100 illustrated in FIG. 10. The tool 100 includes an elongated shank 102 having a cylindrical handle 104 on one end and a reduced diameter portion 104 on its other end equipped with an O-ring 106 mounted in an appropriate groove provided therefore and diametrically opposite radially outwardly projecting studs 108 which may comprise the opposite ends of a diametric pin. In addition, the diametrically reduced portion 104 terminates in a further diametrically reduced terminal end 110. The terminal end 100 is receivable within the outer end of the metering bore formed in the main jet 20, the diametrically reduced portion 104 is receivable in the counter bore of a main jet 20 and the studs 108 are receivable in the opposite ends of the screwdriver kerf 112 formed in the outer end of each metering jet 20. In this manner, with the O-ring 106 snugly received within the counter bore 114 of the metering jet 20, the metering jet 20 may be unscrewed, removed through the bore from which the corresponding plug 30 was removed and a new or different size metering jet may be installed in a manner which is believed obvious, all without removal of the corresponding fuel bowl. Thus, metering jet changes to the carburetor 10 may be carried out within two minutes and with little chance of contamination of the interior of the carburetor 10.

Figure 2:
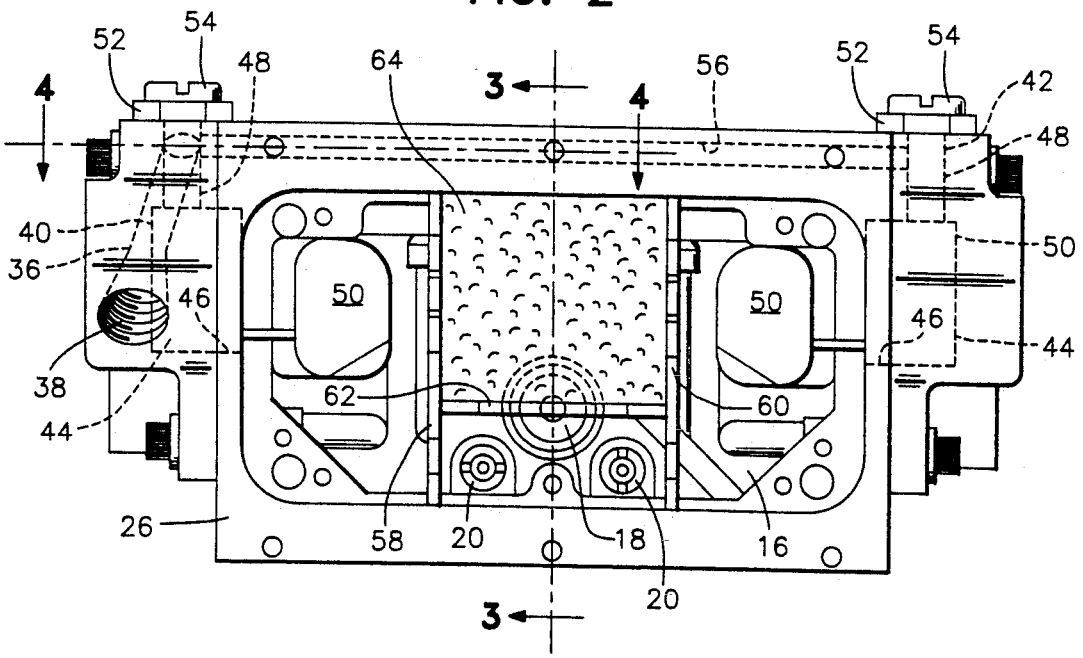
FIG. 2 is an enlarged elevational view of the right hand fuel bowl and primary metering block of the carburetor illustrated in FIG. 1 with the side cover of the fuel bowl removed.

Further, it will be noted from FIGS. 1 and 2 that the floats 50 are mounted closely adjacent opposite ends of the float bowls 14 and 16 at substantially maximum distances apart and as far remote as possible from jets 20. This is done to both segregate the floats 50 from the jets 20 and to enable them to act in harmony and also independently in a common bowl. Also this mounting of the floats 50 enables maximum separation of the jets 20 from the float valve needle and seat assemblies adjacent which fuel having air entrained therein may be present and the length of time for such fuel to travel to the jets 20 is sufficient for the entrained air to escape. Finally, the upper transfer passage 56 is oval in cross sectional shape to greatly reduce the swirling or vortex forming of fuel passing through the passage 56.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalence may be resorted to, falling within the scope of the invention.

What is claimed is:

1. In a carburetor of the type including a main body defining a plurality of venturis and having (1) at least one primary metering block removably sealingly mounted to a corresponding side of said body and including main fuel passages opening through said block with main jets controlling the flow of fuel through said passages and removable from the side of said block remote from said body and (2) a laterally opening float bowl opening toward and sealingly secured over the side of said block remote from said body; the improvement comprising said bowl including two opposite end fuel inlet chambers each including a vertical passage having a fuel inlet line fitting communicated with an upper portion of said vertical passage for communication with a fuel delivery line outlet end, a lower fuel outlet opening directly into a lower portion of said bowl from a lower portion of said passage, a float controlled valve in an intermediate portion of said passage with each valve being under the operative control of a corresponding float within the corresponding end of said float bowl and an elongated upper fuel transfer passage in said bowl extending longitudinally thereof and including opposite ends opening into said upper portions of said vertical passages upstream from the corresponding float controlled valve.

2. The carburetor of claim 1 wherein the interior of said float bowl is divided into two opposite end float chamber sections in which the corresponding floats are received and a central chamber zone disposed between said float chamber sections through the utilization of perforated upstanding baffles within said float bowl operative to prevent free back and forth sloshing of fuel within said float bowl between said lower fuel outlet openings.

3. The carburetor of claim 2 wherein said main jets open into a lower portion of said central chamber zone.

4. The carburetor of claim 3 wherein said central chamber zone includes a perforated horizontal partition extending between said upstanding baffles above said central chamber zone lower portion, and a fibrous body disposed in said central chamber zone above said horizontal partition.

5. The carburetor of claim 1 including a pair of tubular main jet relocating adaptors each including a first threaded end, said main fuel passages including threaded ends opening through the side of said block remote from said body, said threaded ends of said adaptors being removably threadedly engaged in the threaded ends of said main fuel passages, the opposite ends of said tubular adaptors being internally threaded with said main jets threadedly secured therein, said adaptors being operable to appreciably outwardly offset said main jets from the side of said block remote from said body to positions closely adjacent the closed outer side of said float bowl.

6. The carburetor of claim 1 wherein said main jets include cylindrical heads projecting outwardly of the side of said block remote from said body, a remote fuel pickup including means defining a pair of angled bores having a first set of ends snugly telescopingly engageable over said heads and a second set of ends disposed closely adjacent and opening outwardly toward one end of said float bowl.

7. The carburetor of claim 1 wherein the side of said float bowl opposite the open side thereof includes a pair of access openings formed therein in which removable plugs are secured, said access openings being registered with said main jets, and an elongated shank type tool lengthwise insertable through said access openings and removably supportively engageable with said main jets in torque transfer relation therewith.

8. The carburetor of claim 7 wherein said jets include counter bores opening outwardly of said cylindrical heads and diametrically opposite radial slots formed in said heads, said tool including one end adapted for releasable supportive engagement with said main jets, said one end including diametrically opposite radially outwardly projecting shanks receivable in said slots and a circumferential O-ring snugly receivable in said counter bore.

9. The carburetor of claim 8 wherein said one end of said tool also includes a diametrically reduced terminal end snugly receivable in said main jets inwardly of said counter bores.

10. In a carburetor of the type including a main body defining a plurality of venturis and having (1) at least one primary metering block removably sealingly mounted to a corresponding side of said body and including main fuel passages opening through said block with main jets controlling the flow of fuel through said passages and removable from the side of said block remote from said body and (2) a laterally opening float bowl opening toward and sealingly secured over the side of said block remote from said body; the improvement comprising a pair of tubular extension main jet relocating adaptors each including a first threaded end, said main fuel passages including threaded ends opening through the side of said block remote from said body, said threaded ends of said adaptors being removably threadedly engaged in the threaded ends of said main fuel passages, the opposite ends of said tubular adaptors being internally threaded with said main jets threadedly secured therein, said adaptors being operable to appreciably outwardly offset said main jets from the side of said block remote from said body to positions closely adjacent the closed outer side of said float bowl.

11. In a carburetor of the type including a main body defining a plurality of venturis and having (1) at least one primary metering block removably sealingly mounted to a corresponding side of said body and including main fuel passages opening through said block with main jets controlling the flow of fuel through said passages and removable from the side of said block remote from said body and (2) a laterally opening float bowl opening toward and sealingly secured over the side of said block remote from said body; the improvement comprising said main jets including cylindrical heads projecting outwardly of the side of said block remote from said body, a remote fuel pickup including means defining a pair of angled bores having a first set of ends snugly telescopingly engageable over said heads and a second set of ends disposed closely adjacent and opening outwardly toward one end of said float bowl.

12. In a carburetor of the type including a main body defining a plurality of venturis and having (1) at least one primary metering block removably sealingly mounted to a corresponding side of said body and including main fuel passages opening through said block with main jets controlling the flow of fuel through said passages and removable from the side of said block remote from said body and (2) a laterally opening float bowl opening toward and sealingly secured over the side of said block remote from said body; the improvement comprising the side of said float bowl opposite the open side thereof including a pair of access openings formed therein in which removable plugs are secured, said access openings being registered with said main jets, and an elongated shank type tool lengthwise insertable through said access openings and removably supportively engageable with said main jets in rotary torque transfer relation therewith.

13. The carburetor of claim 12 wherein said jets include counter bores opening outwardly of said cylindrical heads and diametrically opposite radial slots formed in said heads, said tool including one end adapted for releasable supportive engagement with said main jets, said one end including diametrically opposite radially outwardly projecting shanks receivable in said slots and a circumferential O-ring snugly receivable in said counter bore.

14. The carburetor of claim 13 wherein said one end of said tool also includes a diametrically reduced terminal end snugly receivable in said main jets inwardly of said counter bores.

* * * * *